US005235718A

United States Patent [19]

Grimsley et al.

[11] Patent Number: 5,235,718

[45] Date of Patent: Aug. 17, 1993

[54] TUBE CLEANING APPARATUS

[75] Inventors: Arvid K. Grimsley, Greenwich; Joseph J. Franzino, Trumbull, both of Conn.

[73] Assignee: Goodway Tools Corporation, Stamford, Conn.

[21] Appl. No.: 782,085

[22] Filed: Oct. 24, 1991

[51] Int. Cl.[5] ..... B08B 9/02

[52] U.S. Cl. ..... 15/104.095; 15/104.33; 15/104.16

[58] Field of Search ..... 15/104.33, 104.16, 104.2, 15/104.095, 104.11, 23

[56] References Cited

U.S. PATENT DOCUMENTS

| | | | |
|---|---|---|---|
| 2,090,174 | 8/1937 | Albright | 15/104.33 |
| 2,467,849 | 4/1949 | O'Brien et al. | 15/104.33 |
| 2,891,268 | 6/1959 | Cheadle | 15/104.2 |
| 3,176,335 | 4/1965 | Ciaccio et al. | 15/104.33 |
| 3,206,782 | 9/1965 | Larsen | 15/104.33 |
| 3,283,353 | 11/1966 | Kirk | 15/104.33 |
| 3,354,490 | 11/1967 | Masters et al. | 15/104.095 |
| 3,394,422 | 7/1968 | Siegal | 15/104.33 |
| 3,399,417 | 9/1968 | Hammond et al. | 15/104.33 |
| 4,546,519 | 10/1985 | Pembroke | 15/104.33 |
| 4,839,936 | 6/1989 | Prange | 15/104.33 |

*Primary Examiner*—Edward L. Roberts
*Attorney, Agent, or Firm*—Patrick J. Walsh

[57] ABSTRACT

A tube cleaning apparatus for tubes and pipes installed in power plant and similar industrial equipment utilizes a rotating brush assembly fitted to one end of a rotary cable encased in a protective casing and driven at its other end in clockwise and counterclockwise rotation by a reversible motor. The invention provides a drive head fitted with a plurality of drive rollers for engaging the protective casing and propelling the casing, cable and brush assembly at a high rate of speed into and out of each tube being cleaned. The drive rollers may be driven by a separately provided reversible motor or by the same motor used for the protective casing. A control mechanism affixed to the drive head enables the operator to manipulate the reversible motor(s) by issuing air pulses to actuate air switches controlling on/off and direction of rotation of the motor(s). An extension device provides for access of the cleaning apparatus particularly the brush assembly to tubes and pipes situated in confined or obstructed locations in a tube sheet. Braking mechanisms are provided for the drive head, protective cable, and the extension device to limit the high speed operational excursion of the brush assembly to tube length.

15 Claims, 5 Drawing Sheets

TUBE CLEANING APPARATUS

BACKGROUND OF THE INVENTION

The present invention relates to the cleaning of tubes and pipes of power plant equipment and machines such as boilers, chillers, condensers, heat exchangers, absorption machines and so forth.

In normal operation, the operating tubes and pipes installed in such power plant equipment and machines become coated with deposits such as soot in the case of fire tube boilers or boiler compound in the case of water tube boilers which over time reduce operating efficiency to a point that the equipment must be taken out of operation for tube cleaning. In tube cleaning, an operator uses commercially available equipment such as the Ream-A Matic made and sold by the assignee of this invention. The Ream-A-Matic utilizes a rotating brush and water flush device which the operator inserts and hand feeds into each tube. Hand feeding of the rotating brush is assisted by rotating the brush in the direction of brush twist into the tube and reversing brush rotation for withdrawal from each tube in a manner very similar to screw rotation. Nonetheless, the cleaning operation is essentially one of hand feeding the device the full length of tubes measuring up to fifty feet in length. The cleaning operation is time consuming even as the the device performs a thorough cleaning of each tube.

When this kind of cleaning is performed the entire plant must be shut down and, often, a full maintenance schedule is carried out for a piece of equipment or for the entire plant. Because of the economic loss sustained during plant shutdown it is imperative that the maintenance schedule be completed as quickly as possible. For example, in a typical electrical utility, hourly loss of power generation revenue is approximately $50,000 during plant shutdown so there is considerable incentive for rapid as well as thorough performance of the maintenance schedule.

The present invention provides an apparatus for substantially reducing the time required for cleaning power plant tubes and pipes without compromising the thoroughness of the cleaning operation.

SUMMARY OF THE INVENTION

The present invention comprises a tube and pipe cleaning apparatus in which an elongated, generally cylindrical brush is rotated about its longitudinal axis and propelled into and withdrawn from a pipe or tube for cleaning the tube interior. A water flush component following behind the rotating brush flushes removed deposits out the other end of the tube. The brush is fitted to the leading end of a flexible rotating shaft which is driven by a reversible motor enabling the operator to rotate the shaft and brush clockwise while entering the tube and counterclockwise while withdrawing the brush. The flexible shaft is encased in an outer flexible sleeve or casing which does not rotate and is normally gripped by the operator as he hand feeds the brush into a tube.

According to the invention, the flexible casing containing the rotary drive shaft is routed through a drive head which propels the casing longitudinally into the tube at a high rate of speed as the rotating brush and water flush clean the tube. On command of the operator, the drive head reverses direction thereby rapidly withdrawing the brush assembly from the tube. The operator repeats this basic operation for each tube to be cleaned.

The drive head is provided with a plurality of drive rollers arranged on opposite sides of the line of travel of the flexible casing through the drive head. Preferably, the drive rollers encroach the line of travel slightly to provide positive driving engagement between the rollers and flexible casing. Roller encroachment results in a characteristic sinusoidal or snake-like path of the flexible casing through the drive head.

Each of the rollers is mounted on a vertical shaft and driven by a gear train comprising spur gears fitted to the base of each shaft. The gear train and rollers are driven by means of a drive pinion connected to a reversible drive motor by means of a flexible drive cable. By controlling direction of rotation of the drive motor the operator propels the brush assembly into and out of each tube. The drive rollers can be provided in sets of different sizes to accommodate flexible cables of various diameters.

According to the invention, the drive head includes an operating handle in the form of an oscillating bellows through which the operator reverses direction of movement of the flexible casing into and out of each tube. The operating handle includes a bellows in the form of a generally cylindrical tube closed at its outer end and mounted for rotation at its inner end to the drive head. By squeezing the bellows the operator sends an air pulse or pneumatic signal to the reversible drive motor to operate the rollers and drive the flexible casing down into a tube. To reverse roller rotation and withdraw the flexible casing, the operator now rotates and squeezes the bellows sending another air pulse to the reversible motor thereby reversing roller rotation and withdrawing the flexible casing. A rotary air valve within the bellows directs each air pulse through suitable tubing to a two way air switch controlling the reversible motor. The bellows, rotary air valve, and the air pulse tubing are formed and assembled in an air tight manner to preserve the signalling integrity of each air pulse.

As noted, industrial tubes of up to fifty feet in length are cleaned by the device of the present invention. Because of tube length as well as the linear speed of the cleaning device into and out of each tube it is necessary to provide braking mechanisms for the flexible casing so that the flexible casing is stopped when the rotating brush reaches the far end of a tube and that the casing is again stopped when the brush clears the near end of the tube on withdrawal.

A first braking device comprises an adjustable collar affixed to the flexible casing at a point or location allowing for normal operating room on the entry end of a tube plus tube length. In operation, as the operator inserts and drives the cleaning head into a tube, the fixed collar eventually encounters the drive head and prevents further movement of the flexible casing into the tube.

A second braking device is affixed to the drive head and preferably comprises a spring loaded lever which catches a collar mounted on the flexible rotary shaft in the vicinity of the rotary brush. As the flexible casing is withdrawn and particularly as the brush clears the near end of a tube and approaches the drive head, the brake lever engages the rotary shaft brake collar thereby preventing further linear movement of the flexible casing through the drive head.

In a modification to the invention, the drive head is provided with an extension tube to enable the operator in positioning the cleaning device adjacent a tube opening in cases where access to the tube by the drive head is restricted by the outer shell or other structural components. The extension tube has an outer diameter slightly greater than an operating tube and less than the lateral dimension of the drive head for access to confined locations. The extension tube is provided with a braking mechanism for arresting flexible casing movement in a manner similar to the drive head. A pair of spring loaded levers project through the extension tube wall for engaging the rotary shaft brake collar thereby arresting linear movement of the the flexible shaft and casing. A biasing spring is mounted outside the extension tube and is compressed between a fixed collar and the exposed portion of each lever so that the braking tips of the levers normally project into the line of travel of the brake collar.

With each braking mechanism there is momentary rolling friction between the drive head rollers and the flexible casing until the rollers are stopped or reversed in direction of rotation. It will be further understood that the individual braking mechanisms are operational in one directional only and the spring loaded lever brakes reset automatically and do not require any intervention by the operator after each tube cleaning operation.

The present invention can be installed in conventional tube cleaning equipment such as Assignee's Ream-A-Matic equipment as a user installed improvement kit or as an integrated factory product. Both embodiments are described below.

OBJECTS OF THE INVENTION

An object of the invention is to provide a tube and pipe cleaning apparatus which significantly reduces the time required for cleaning power plant equipment.

Another object of the invention is to provide a tube and pipe cleaning apparatus having a drive head for power feed of a cleaning device into and out of tubes.

Another object of the invention is to provide a control mechanism enabling an operator to conveniently and quickly control projection and withdrawal of a cleaning device into and out of tubes.

Another object of the invention is to provide a braking mechanism for stopping linear movement of the cleaning device as it clears the far end of a workpiece tube.

Another object is to provide a braking mechanism for stopping linear movement of the cleaning device as the brush assembly exits the near end of a workpiece as the assembly is withdrawn from a tube.

A further object of the invention is to provide an extension device for providing access of the brush assembly to tubes positioned in confined areas of the tube sheet of a boiler or similar equipment.

A further object of the invention is to provide a braking mechanism for the extension device for stopping linear movement of the cleaning device as it emerges from the near end of a tube.

Other and further objects of the invention will become apparent with an understanding of the following detailed description of the preferred embodiment of the invention or upon employment of the invention in practice.

DESCRIPTION OF THE DRAWING

A preferred embodiment of the invention has been chosen for purposes of illustrating the operative principles of the invention and is shown in the accompanying drawing in which.

DETAILED DESCRIPTION OF THE PREFERRED EMBODIMENT

Figure 1:
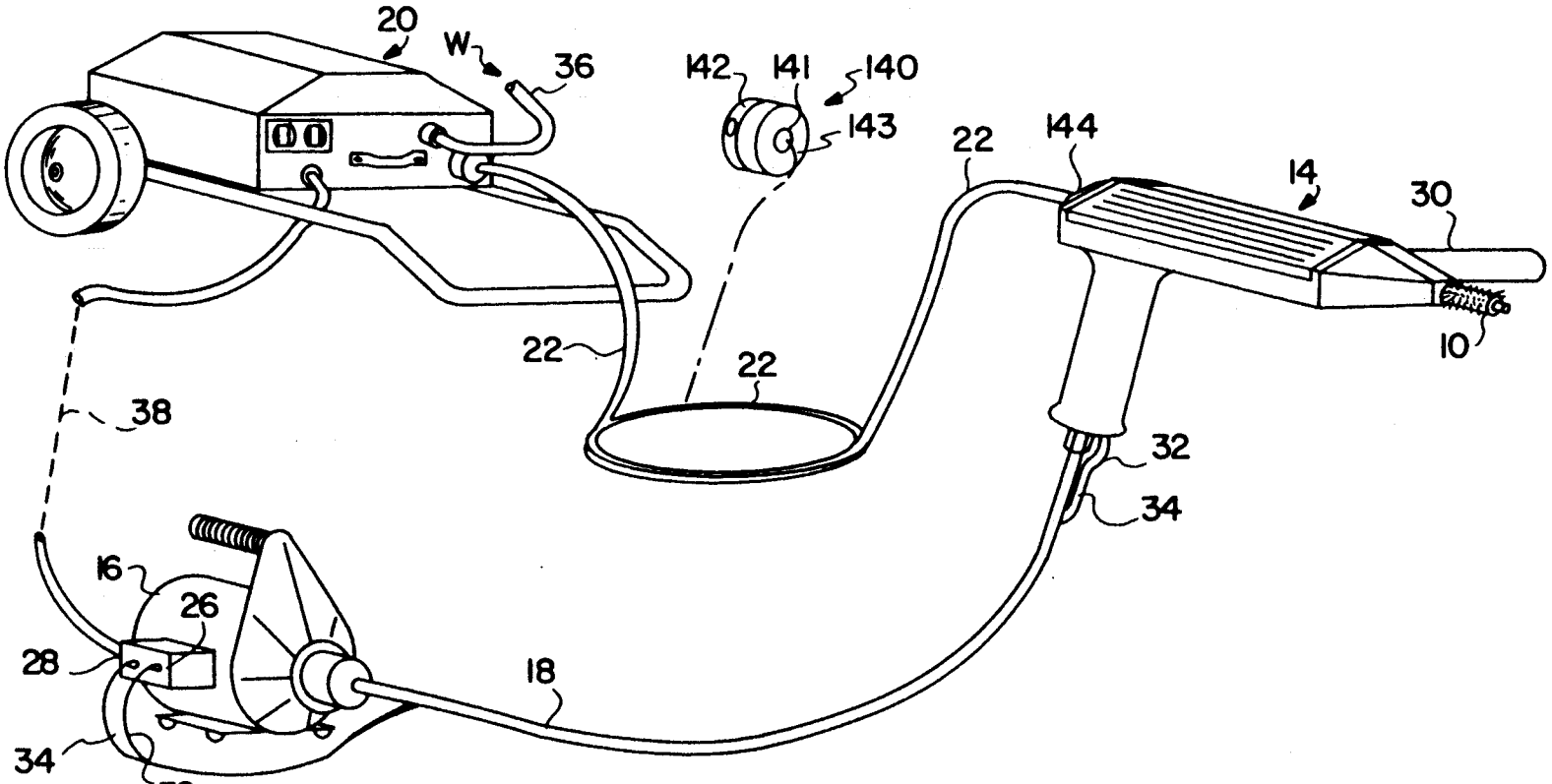
FIG. 1 is a schematic view of a tube cleaning apparatus according to the present invention.
Figure 2:
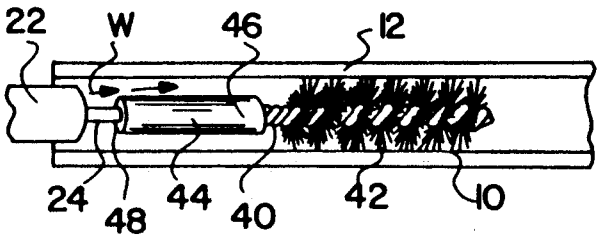
FIG. 2 is a schematic view partly in section of a cleaning brush assembly used with the present invention and shown in cleaning position within a tube or pipe.

Referring to FIGS. 1 and 2 of the drawing, the present invention is primarily concerned with rapidly driving a cleaning brush 10 down and back the full length of a tube 12 forming part of industrial equipment such as a condenser, heat exchanger and the like. A preferred embobiment of the cleaning apparatus includes a drive head 14 normally held and used by the tube cleaning operator for propelling and withdrawing the brush from a tube, a reversible drive motor 16 providing rotary drive to the drive head via a flexible drive cable or shaft 18, and a drive console 20 incorporating a second drive motor for rotating the cleaning brush via a flexible casing 22 encasing a flexible drive shaft 24. The reversible drive motor is controlled by forward 26 and reverse 28 air switches. The drive head includes a control handle 30 comprising a squeezable bellows that issues air pulses to the air switches via forward 32 and reverse 34 pneumatic tubes. The control handle 30 is further rotatable on its axis between forward and reverse positions enabling the operator to project or withdraw (i.e., forward or reverse) the flexible casing from a boiler tube by simply rotating and squeezing the control handle as the means of actuating the reversible drive motor as described in detail below.

The drive console 20 is a commercial product available from the assignee of this application under the trade designation Ream-A-Matic. As illustrated the drive console is provided with a water inlet 36 for supplying flushing water W to the brush assembly via the flexible casing. An electrical power line 38 interconnects the drive console and the reversible motor so that both are controlled by an operator using the drive head control handle 30.

The brush 10 is of suitable design as for example having a twisted wire spine 40 securing bristles 42 in a well known manner. A brush of this kind is particularly suited for rotary cleaning of a tube because the bristles are wound in a twist or spiral having a natural tendency to move along the tube in the direction of twist in the manner of a screw thread. Accordingly, the brush moves down into the tube with clockwise rotation of the brush and is withdrawn with opposite rotation. The brush assembly further includes a mounting collar 44 having an internally threaded tip 46 for receiving the near end of the brush spine. The mounting collar is secured to flexible drive shaft 24 by a compression fit and has a trailing end 48 for cooperation with a braking mechanism 50 (FIG. 4) more fully described below. The flexible drive shaft 24 is of suitable manufacture such as wound steel cable employed for speedometer cables in automotive applications. The flexible drive shaft is encased in a flexible sheath or casing which does not rotate and is normally gripped by the operator in hand feeding the cleaning device into boiler tubes and the like. As noted, the brush assembly provides a stream of flushing water W (FIG. 2) issuing from the flexible casing to wash dislodged deposits out the far end of each tube.

Figure 3:
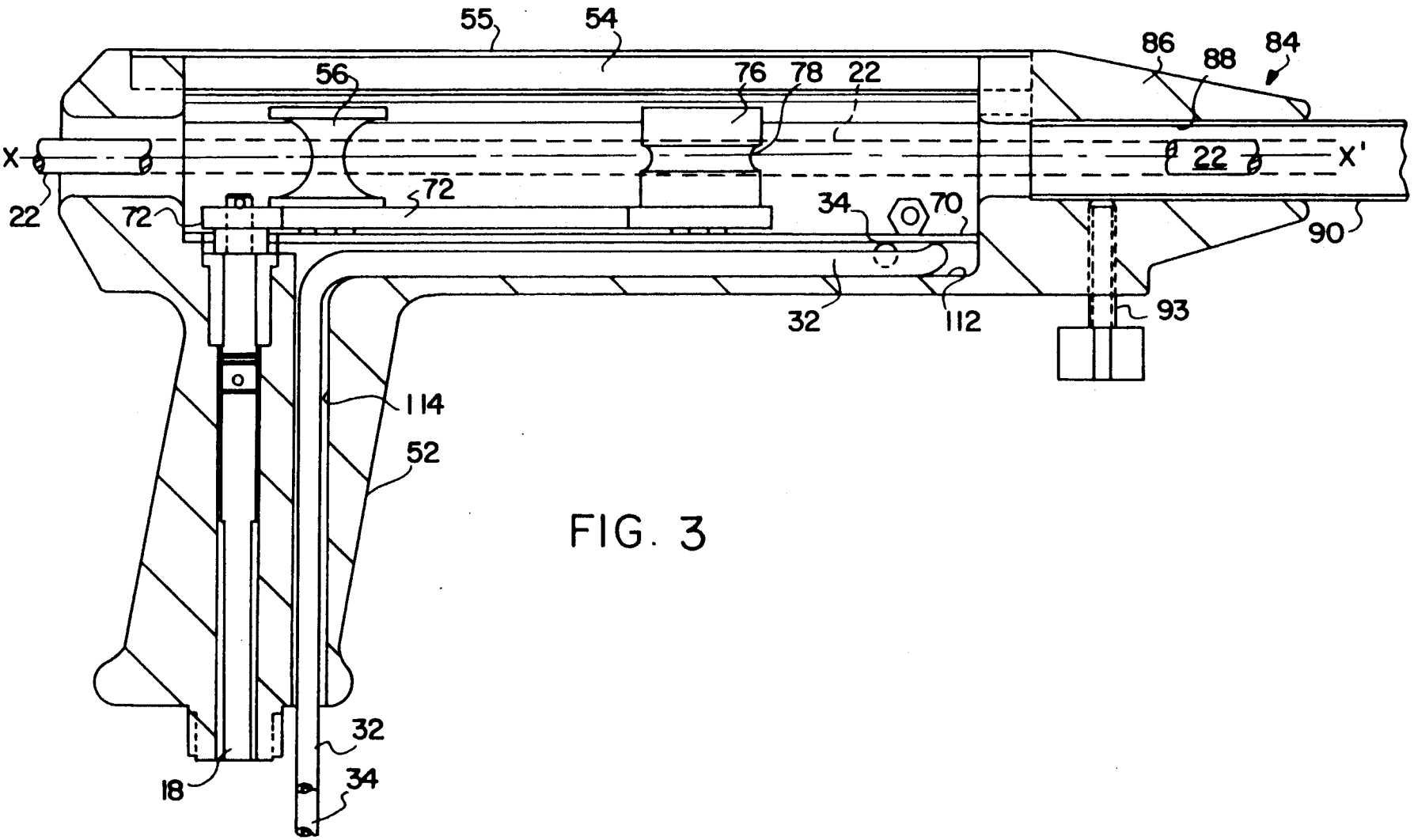
FIG. 3 is a side elevational view in section of a drive head forming part of the tube cleaning apparatus of the present invention.
Figure 4:
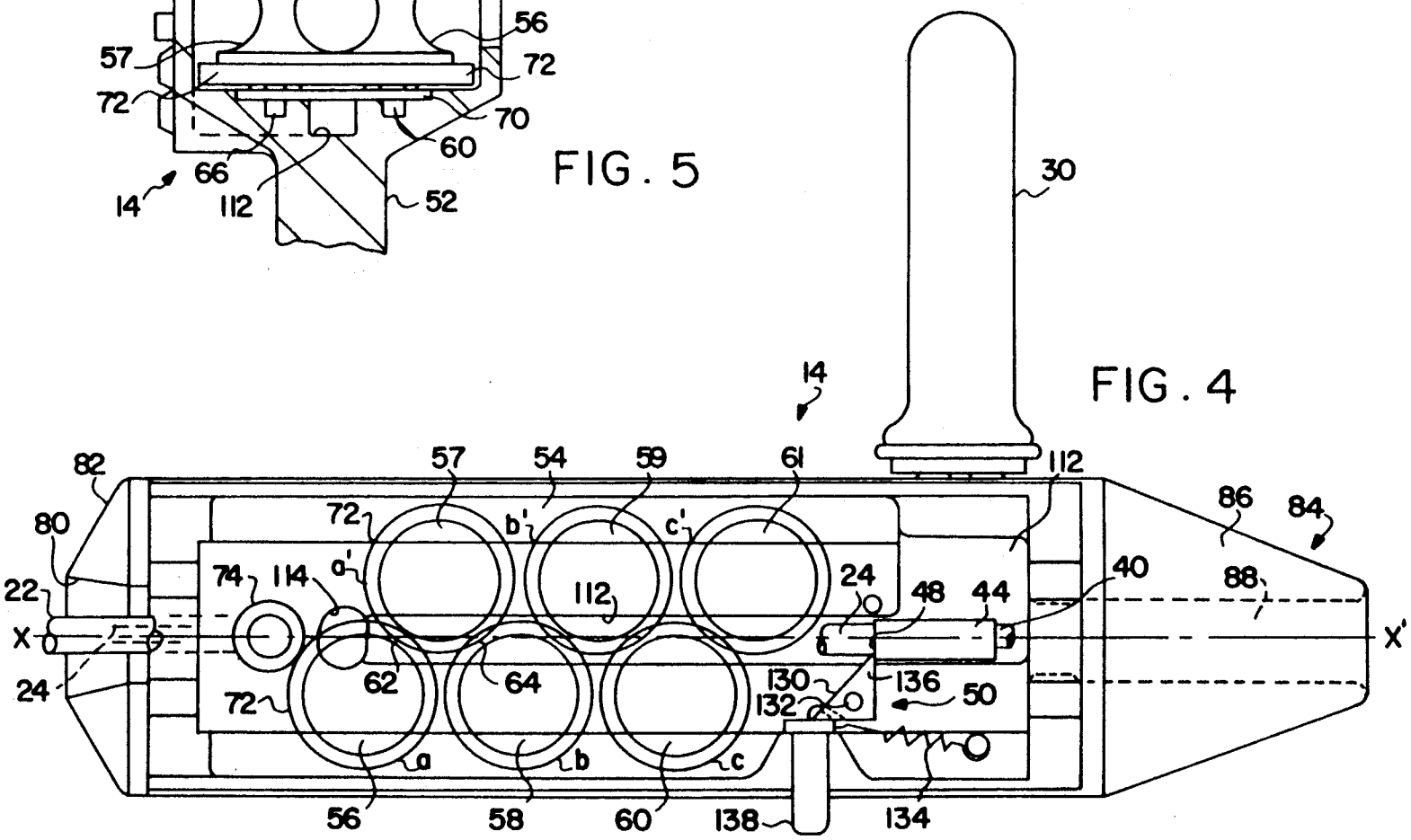
FIG. 4 is a plan view of the drive head of FIG. 3 with its top cover removed to illustrate the line of travel through the drive head, the arrangement of drive rollers for the flexible casing, and operating position of a brake mechanism for the flexible casing.
Figure 5:
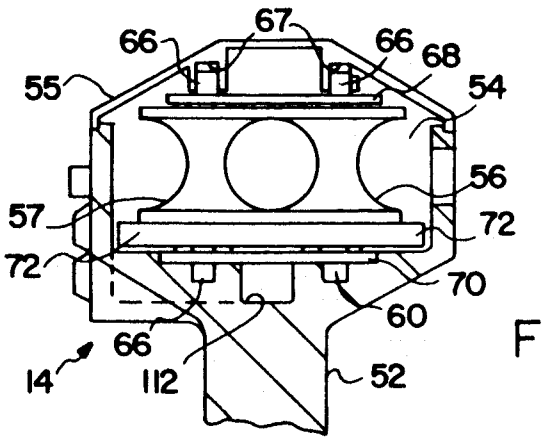
FIG. 5 is an end view of of the drive head of FIG. 3 showing a preferred arrangement for mounting drive rollers.

In accordance with the present invention, the brush assembly is fed into individual tubes by means of the drive head 14 illustrated in FIGS. 3–5. The drive head includes a pistol grip 52 used by the operator in positioning the drive head adjacent each tube during a cleaning operation. The drive head further includes an upper elongated chamber 54 having a removable cover 55 and encompassing a line of travel x–x′ for the flexible casing 22. A plurality of concave rollers 56–61 are positioned on either side of the line of travel for driving the flexible casing 22 into or out of a tube according to the direction of roller rotation. In order to provide positive driving engagement of the casing, the rollers are nested and encroach the line of travel so the casing takes on a sinuous form as it negotiates the roller section during operation. As shown in FIG. 4, roller 57, for example, is nested between and forms nips 62, 64 with rollers 56 and 58 for driving the flexible casing through a sinuous line of travel.

The rollers 56–61 are fitted to and freely rotate about vertical support shafts 66 positioned between upper 68 and lower 70 holding plates. Each roller has a horizontally disposed gear 72 forming part of a gear train for rotating the rollers as they cooperate in injecting or withdrawing the brush assembly from each tube. The gears are marked as shown in FIG. 4 with gear drive proceeding as follows: a–a′; a′–b; b–b′; b′–c; and c–c′ so that the gears on either side of the line of travel x–x′rotate in the same direction when driving the flexible casing. As shown in FIGS. 3 and 4, the gear train 72 a–c′ is driven by means of a pinion 78 which is powered by flexible drive shaft 18 extending through the pistol grip to the reversible drive motor 16. A drive head according to the invention may accommodate flexible casings in a variety of diameters as required for different cleaning operations. Rollers shown in FIGS. 3 and 4 accommodate larger size casings. Roller 76 also shown in FIG. 3 has a smaller concavity 78 for a smaller diameter flexible casing and would normally be used with a set of identical rollers. A tube cleaning apparatus includes several sets of rollers as accessories to be selected and installed in the drive head by the operator according to the flexible casing diameter required for a particular work piece tube diameter. A set of rollers is installed by removing cover 55 and mounting the rollers on drive shafts 66. The under side of the cover 55 is fitted with recesses 67 to receive the upper ends of support shafts 66.

Figure 10:
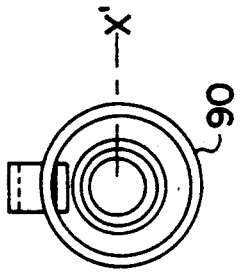
FIG. 10 is an end view thereof.
Figure 9:
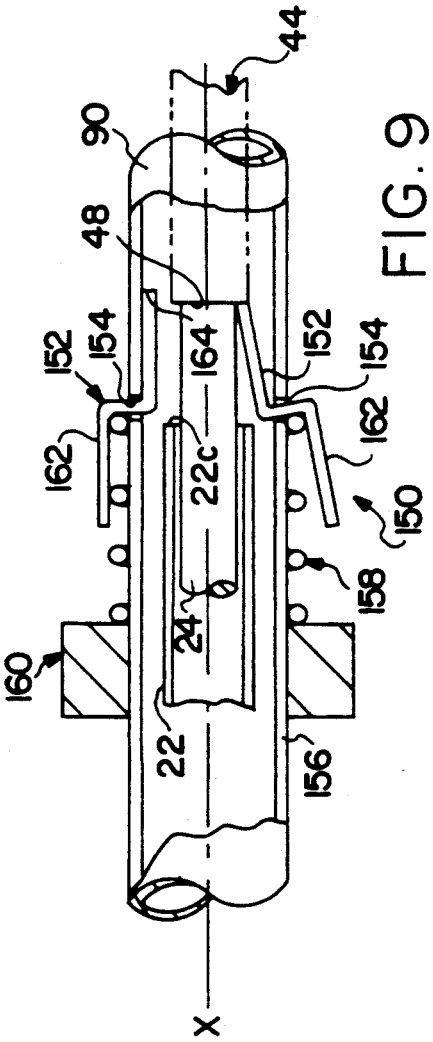
FIG. 9 is a fragmentary section view showing the essential components of the extension tube modification for the present invention.

An opening 80 in the rear wall 82 of the drive head provides for access of the flexible casing 22 through the drive head along the line of travel. The front end 84 of the drive head is provided with a tapered nose 86 having an internal passage 88 defining a continuation of the line of travel. An extension tube 90 visible in FIG. 3 is also shown in FIGS. 9 and 10 and is more fully described below.

The drive head is provided with a control mechanism 30 (FIG. 1), preferably mounted to the left side wall of the drive head 14 for enabling the operator to stop and start rotation of the drive head rollers in either direction for the purpose of feeding and retracting the flexible casing 22 from each tube. The control mechanism comprises a generally cylindrical flexible bellows 91 rotatably mounted to the drive head so that the operator may rotate the bellows between forward and reverse drive positions, and, by squeezing the bellows send an air pulse to an air switch control for the reversible drive motor 16. With the control in the forward position, an air pulse is routed to the forward air switch 26 through a first or forward air tube 32, and in the reverse position an air pulse passes through the control mechanism and second or reverse air tube 34 to the reverse air switch 28.

Figure 6:
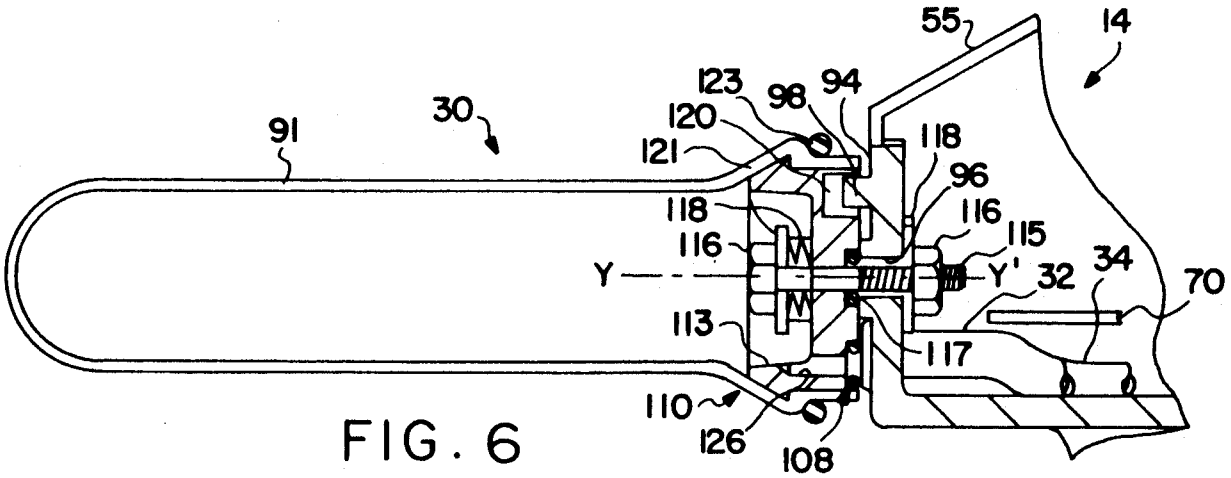
FIG. 6 is a plan view partly in section of a preferred mechanism forming part of the drive head enabling the operator to stop the cleaning device and select the direction of travel of the flexible casing into and out of each tube cleaned.
Figure 8:
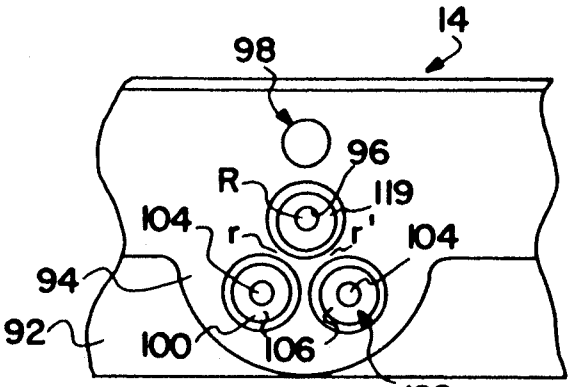
FIG. 8 is a fragmentary side view of the interface surface of the drive held for mounting the control mechanism.
Figure 7:
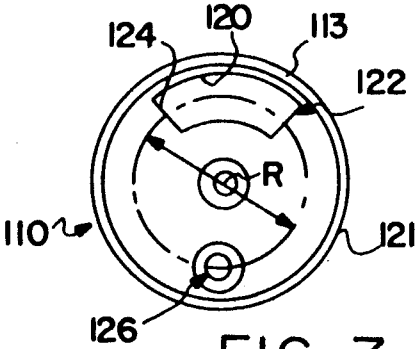
FIG. 7 is side view of a valve for the control mechanism of FIG. 6. illustrating the interface surface of the valve.

As shown in FIGS. 6–8, the side wall 92 of the drive head 14 is provided with a vertically oriented mounting face 94 including a mounting bore 96 to which the control mechanism 30 is attached for oscillating movement. A position pin 98 is formed in the mounting face to limit the forward and reverse excursion of the control mechanism. Spaced air ports 100, 102 for receiving forward and reverse air pulses are located on equal radii from the center of rotation R of the bore. Flexible air tubing 32, 34 of suitable construction interconnects each of the air ports 100, 102 to the air switch controller 26, 28 (FIG. 1) of the reversing motor. Each of the air ports is formed integral with the mounting face and includes an interior air passage 104 and an exterior sealing surface 106 for engagement with a sealing O-ring 108 fitted to an air valve 110.

As best shown in FIGS. 3, 4, and 6, the flexible tubing 32, 34 is routed through the drive head from the air ports 100, 102 by way of a recess 112 located under lower holding plate 70 and down through vertical passage 114 in the pistol grip 52 and onward to the air switches.

The control mechanism further includes air valve 110 comprising a valve manifold 113 for directing the air pulses to the proper air switch. The air valve is affixed to the drive head by a mounting bolt 115, fasteners 116 and spring 118 which allow for rotation of the valve manifold about the mounting bolt axis y–y′. An O-ring 117 fitted to the air valve engages a sealing surface 119 around bore 96 to establish an air tight seal about the mounting bolt. The air valve is provided with a slot 120 having forward 122 and reverse 124 end walls for receiving the position pin 98 limiting excursion of the control mechanism to forward and reverse positions about the axis of rotation y–y′. An air port 126 in the air valve aligns with either of the mounting face airports 100, 102 and directs air pulses to the air switches.

The flexible bellows 91 is fitted to the air valve 110 enabling the operator to generate air pulses by squeezing the bellows. An air tight seal between bellows and valve is formed by means of annular shoulder 121 and an O-ring retainer 123. An air pulse will travel to the forward or reverse air switch in accordance with the alignment of air ports selected by the operator.

To propel the flexible casing into a workpiece tube, the operator rotates the control bellows 91 in a forward direction. The position pin 98 cooperating with the forward end wall 122 of valve slot 120 stops the bellows in the forward position with the valve air port 126 in registry with the forward air port 100. By squeezing the bellows an air pulse travelling through tubing 32 actuates the forward air switch causing the drive motor to rotate in the forward direction. To stop the drive motor, the operator simply releases the bellows. For reverse operation, the operator proceeds in similar manner after reverse rotation of the bellows to align the valve air port 126 with the reverse air port 102.

A braking mechanism 50 for arresting return movement of the flexible casing is made part of the drive head and is illustrated in FIG. 4. The brake mechanism comprises a lever 130 carried on a pivot shaft 132 and spring-loaded 134 normally to engage the flared end 48 of the brake collar 44 affixed to the flexible drive shaft 24 for stopping the flexible casing. The pivot shaft 132 is mounted between upper 68 and lower 70 holding plates (FIG. 5) and receives and positions the pivoted lever for oscillating movement into the position indicated in FIG. 4. The coil spring 134 biases the lever toward the position shown wherein the angled braking tip 136 of the lever normally rides along the outer surface of the flexible casing 22 as it moves forward and backward through the drive head. When the flexible casing is returning along the line of travel and the brush assembly approaches the brake lever, the lever tip 136 rides off the end of the flexible casing, along the flexible drive shaft for a brief interval, then encounters the flared brake collar and stops the brush assembly. When the flexible casing is propelled into a boiler tube (to the right of FIG. 4), the lever 130 simply rotates clockwise against the spring force and rides along the flexible shaft and casing. When a cleaning operation has been completed and the operator wishes to stow the cleaning apparatus, he may remove the brush assembly through the drive head along the line of travel by pressing the push button 138 and moving the brake lever tip 136 out of the path of the brake collar freeing the brush assembly to move in reverse and out of the drive head. The lever spring 134 will return the push button as well as brake lever to normal positions after the push button is released.

The invention further includes a forward braking mechanism 140 (FIG. 1) in the from of a collar 142 affixed through opening 141 to the flexible casing 22 at a distance along the flexible casing from the brush assembly approximately equal to the linear distance from the far end of a workpiece tube to the rear face 144 of the drive head as it is held in normal operating position. Accordingly, when the cleaning device is propelled down a tube during cleaning operations, the braking collar 142 carried by the flexible casing will encounter the rear face 144 of the drive head as the cleaning brush assembly clears the far end of a workpiece tube. The collar is of suitable construction for rigid attachment to the casing and preferably includes a soft face 143 to absorb impact shock with the drive head. The braking collar stops the flexible casing and the operator manipulates the control mechanism reversing rotation of the drive head rollers to retract the flexible casing and brush assembly for insertion into the next tube.

With each braking mechanism there is momentary rolling friction between the drive head rollers and the flexible casing until the rollers are stopped or reversed in direction of rotation. It will be further understood that the individual braking mechanisms are operational in one direction. The spring loaded lever brake of FIG. 4 resets automatically and does not require any intervention by the operator after each tube cleaning operation.

In a modification to the invention, the drive head is provided with an extension tube 90 (FIGS. 3, 9 and 10) to enable the operator in positioning the cleaning device adjacent a tube opening in situations where access to a tube directly by the drive head is restricted or obstructed by the outer shell or other structural components of a boiler or heat exchanger. The extension tube has an outer diameter slightly greater than a workpiece tube and less than the width of the drive head for access to confined locations. The extension tube fits into the front opening 88 of the drive head 14 and is secured therein by means of a retaining screw 93. The extension tube is provided with a braking mechanism 150 for arresting flexible casing movement in a manner similar to the drive head brake mechanism 50 described above. A pair of Z-shaped spring loaded levers 152 project through openings 154 in the extension tube wall 156 for engaging brake collar 44 thereby arresting linear movement of the the flexible shaft 24 and casing 22. A biasing spring 158 is mounted outside the extension tube and is compressed between a fixed collar 160 and the exposed portion 162 of each Z-shaped lever so that the braking tips 164 of the Z levers normally project into the line of travel x–x′ of the brake collar. The coil spring biases the levers toward the position shown (see lower lever 162 of FIG. 9) wherein the angled braking tips of the levers normally ride along the outer surface of the flexible casing as it moves forward and backward through the drive head. As the brush assembly approaches the brake levers, the lever tips ride off the end **22*e* of the flexible casing, along the flexible drive shaft 24 for a brief interval, then encounter the flared brake collar 48 and stop the brush assembly. When the flexible casing is propelled into a boiler tube (to the right of FIG. 10), the levers simply rotate against the spring force and ride along the flexible shaft and casing. When a cleaning operation has been completed and the operator wishes to stow the cleaning apparatus, he may remove the brush assembly through the extension tube and drive head along the line of travel by pressing both levers toward the tube thereby moving the brake lever tips 164 out of the path of the brake collar (see upper lever of FIG. 9**) freeing the brush assembly to move to the rear and out of the drive head. The lever spring will restore the brake levers to normal positions after the brush assembly passes.

Figure 11:
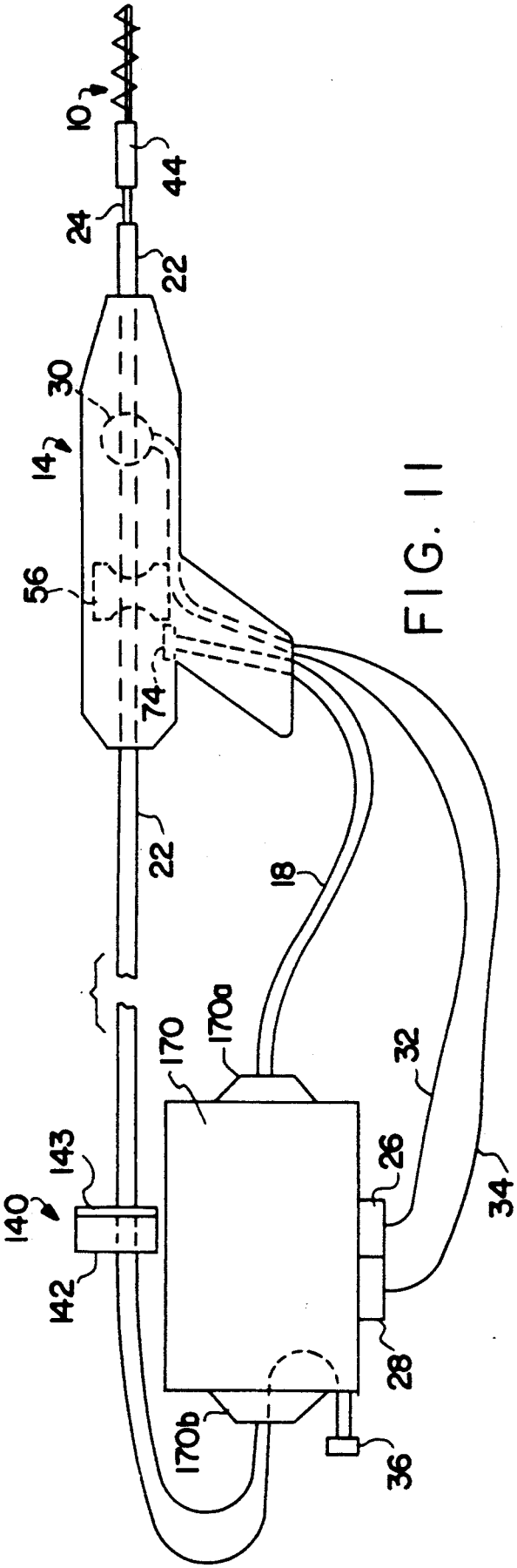
FIG. 11 is a schematic view of a modified general arrangement of the invention.

In a modification to the general arrangement of the invention, the tube cleaning apparatus may be fabricated as an integrated product at the factory. In this arrangement of FIG. 11, a single reversible drive motor 170 operates both flexible drive shafts 18, 22 from opposite ends 170 *a–b* of the motor. Rotation of the drive shafts is coordinated so the drive head 14 propels the flexible into a tube as the brush assembly is rotated in forward direction and vice versa. Flushing water is provided through the flexible casing in the usual manner via inlet 36. The control mechanism 30 enables the operator to actuate the drive head and brush assembly rotation in this coordinated manner by means of air tubes 32, 34 and air switches 26, 28 as described.

It is within the scope of the invention to utilize drive head 14 together with a non-rotating brush assembly for cleaning tubes. In this embodiment of the invention, the brush assembly 10 as shown in FIG. 1 is attached to the end of flexible casing 22 while an interior flexible drive shaft is omitted. Purging water W or air (not indicated in the drawing) is provided through the hollow casing 22 to carry away deposits dislodged from tube surfaces by brushing action.

We claim:

1. A tube cleaning apparatus for equipment having a plurality of tubes comprising an elongated cable having a brush assembly affixed to one end thereof for cleaning the interior surfaces of tubes, a flexible protective casing covering substantially the full length of the cable, means connected to the other end of the cable for reversibly rotating the cable and brush assembly within the flexible protective casing, a portable drive head having an interior passage defining a line of travel for the cable, the drive head having rotary means for engaging the casing intermediate its ends and for propelling the rotating cable and brush assembly into and out tubes for cleaning the interior surfaces of the tubes, means for reversibly driving the rotary means, and the drive head having means enabling an operator in controlling movement of the cable and brush assembly into and out of each tube.

2. A tube cleaning apparatus comprising an elongated cable having a brush assembly affixed to one end thereof for cleaning the interior surfaces of tubes, a flexible protective casing covering substantially the full length of the cable, means connected to the other end of the cable for reversibly rotating the cable and brush assembly, a drive head for engaging the casing intermediate its ends and for propelling the rotating cable and brush assembly into and out of tubes for cleaning the interior surfaces of the tubes, the drive head having rotary means for engaging and propelling the cable and brush assembly, means for reversibly driving the rotary means, means for controlling movement of the cable and brush assembly into and out of each tube, and first and second brake devices for limiting excursionary movement of the cable and brush assembly to length of tube being cleaned.

3. A tube cleaning apparatus as defined in claim 2 in which the drive head comprises an elongated housing encompassing a line of travel of the casing, the housing having a grip enabling the operator to hold the drive head in operative position with respect to a tube, the second brake device stopping cable and brake assembly movement out of a tube after cleaning, and in which the means for controlling brush and cable movement is affixed to the drive head.

4. A tube cleaning apparatus as defined in claim 2 in which the drive head comprises an elongated housing encompassing a line of travel of the casing, the housing having a grip enabling the operator to hold the drive head in operative position with respect to a tube, the drive head rotary means including a plurality of rollers within the housing arranged along both sides the line of travel for engaging the casing and propelling the cable and brush assembly, the rollers being interconnected by a gear train driving the rollers on either side of the line in the same direction, means for driving the gear train, and in which the means for controlling brush and cable excursionary movement also controls cable and brush assembly rotation.

5. A tube cleaning apparatus as defined in claim 2 in which a common prime mover reversibly rotates the cable and brush assembly and reversibly drives the drive head rotary means.

6. A tube cleaning apparatus comprising an elongated cable having a brush assembly affixed to one end thereof for cleaning the interior surfaces of tubes, a flexible casing covering substantially the full length of the cable, an air switch actuated motor connected to the other end of the cable for reversibly rotating the cable and brush assembly, a drive head for engaging the casing intermediate its ends and for propelling the rotating cable and brush assembly into and out tubes for cleaning the interior surfaces of the tubes, the drive head having rotary means driven by the air switch activated motor for engaging and propelling the cable and brush assembly, means for controlling excursion of the cable and brush assembly into and out of each tube and rotation of the brush and cable assembly the control means including a fixed base, the base having spaced air openings for passing air pulses, a manifold mounted for rotation on the base and having an air port selectively communicating with each of the air openings, a bellows for generating air pulses, and means for directing the air pulses in controlling relationship to the air switch actuated motor for rotating and propelling the cable and brush assembly.

7. A tube cleaning apparatus comprising an elongated cable having a brush assembly affixed to one end thereof for cleaning the interior surfaces of tubes, a flexible casing covering substantially the full length of the cable, means connected to the other end of the cable for reversibly rotating the cable and brush assembly, a drive head for engaging the casing intermediate its ends and for propelling the rotating cable and brush assembly into and out tubes for cleaning the interior surfaces of the tubes, the drive head having rotary means for engaging and propelling the cable and brush assembly, means for controlling excursion of the cable and brush assembly into and out of each tube and rotation of the brush and cable assembly the control means including a mounting face forming part of the drive head, the face having a position pin, a mounting bore, and a pair of spaced air passages formed therein for passing air pulses, a manifold secured to the mounting bore for rotation on the base, the manifold having an air port selectively communicating with each of the air passages and a positioning slot cooperating with the position pin, a bellows for generating air pulses affixed in air-tight relationship to the manifold, air switch means for controlling the means for rotating and propelling the cable and brush assembly, and means for directing the air pulses to the air switch means.

8. A tube cleaning apparatus comprising an elongated cable having a brush assembly affixed to one end thereof for cleaning the interior surfaces of tubes, a flexible casing covering substantially the full length of the cable, means connected to the other end of the cable for reversibly rotating the cable and brush assembly, a drive head for engaging the casing intermediate its ends and for propelling the rotating cable and brush assembly into and out tubes for cleaning the interior surfaces of the tubes, the drive head having rotary means for engaging and propelling the cable and brush assembly, means for controlling excursion of the cable and brush assembly into and out of each tube and rotation of the brush and cable assembly, the control means including a mounting face forming part of the drive head, the face having a position pin, a mounting bore, and a pair of spaced air passages formed therein for passing air pulses, a manifold secured to the mounting bore for rotation on the base, the manifold having an air port selectively communicating with each of the air passages and a positioning slot cooperating with the position pin, a bellows for generating air pulses affixed in air-tight relationship to the manifold, the position pin and the positioning slot being spaced on equal radii from the center of rotation and together defining the limits of rotation of the manifold between a first position in which the air port is aligned with one of the air passages and a second position in which the air port is aligned with the other air passage, air switches for controlling the means for rotating and propelling the cable and brush assembly, and pneumatic tubing for directing the air pulses to the air switches, so that by rotating the bellows to the first or second positions and by squeezing the bellows an air pulse is generated and directed to an air switch for rotating and moving the cable and brush assembly for tube cleaning.

9. A tube cleaning apparatus comprising an elongated cable having a brush assembly for cleaning the interior surfaces of tubes affixed to one end thereof by means of a connecting collar, a flexible casing covering substantially the full length of the cable ending a short distance from the connecting collar, means connected to the other end of the cable for reversibly rotating the cable and brush assembly, a drive head for engaging the casing intermediate its ends and for propelling the rotating cable and brush assembly into and out of tubes for cleaning the interior surfaces of the tubes, the drive head having rotary means for engaging and propelling the cable and brush assembly, means for reversibly driving the rotary means, means for controlling movement of the cable and brush assembly into and out of each tube, a first brake device comprising a collar affixed to the flexible casing a predetermined distance from the drive head for stopping forward movement of the cable and brush assembly when the collar encounters the drive head, and a second brake device comprising a lever affixed to the drive head by means of a pivot shaft enabling the lever to pivot into and out of the line of travel of the connecting collar and to engage the connecting collar and stop rearward movement of the cable and brush assembly as collar and brush assembly exit a tube after cleaning.

10. A cleaning apparatus for heat exchanger tubes and the like comprising an elongated cable having a brush assembly for cleaning the interior surfaces of tubes, the brush assembly affixed to one end of the cable by means of a connecting collar, a flexible protective casing covering substantially the full length of the cable, means connected to the other end of the cable for reversibly rotating the cable and brush assembly, a drive head for engaging the casing intermediate its ends and for propelling the rotating cable and brush assembly along a line of travel into and out tubes for cleaning the interior surfaces of the tubes, the drive head having rotary means for engaging and propelling the cable and brush assembly, means for controlling movement of the cable and brush assembly into and out of each tube, an extension tube fitted to the drive head along the line of travel for providing access of the brush assembly to tubes situated in confined locations in the heat exchanger, and the extension tube having a brake mechanism for stopping rearward movement after the brush assembly has been withdrawn from a tube.

11. A cleaning apparatus as defined in claim 10 in which the braking mechanism comprises an opening in the extension tube wall, a Z-shaped lever projecting through the wall having one end projecting into the line of travel of the flexible casing and cable through the extension tube, means for urging the one end to remain in the line of travel thereby engaging the connecting collar and stopping rearward movement of the brush assembly.

12. A cleaning apparatus as defined in claim 10 in which the braking mechanism comprises a pair of openings in the extension tube wall, a pair of Z-shaped levers projecting through the wall openings with each lever having one end projecting into the line of travel of the flexible casing and cable, a spring encircling the extension tube and engaging the levers as they pass through their openings for urging the lever ends to remain in the line of travel thereby engaging the connecting collar and stopping rearward movement of the brush assembly, and means secured to the extension tube for compressing the spring in engagement with the levers.

13. A tube cleaning apparatus for industrial equipment and the like fitted with a plurality of tubes comprising an elongated cable having a cleaning device affixed thereto for cleaning the interior surfaces of tubes, a portable head member carried by an operator having an elongated path defining a line of travel for receiving and directing the cable for insertion into and withdrawal from each tube, means engaging the cable intermediate its ends for forward and reverse propelling of the cable through the head member and into and out tubes for cleaning the interior surfaces of the tubes, reversible means for selectively driving the cable propelling means in the forward and reverse directions, and the portable head having control means for issuing air pulses to the reversible means for enabling the operator to select forward and reverse movement of the cable and cleaning device while cleaning each tube.

14. A tube cleaning apparatus for industrial equipment and the like fitted with a plurality of tubes comprising an elongated cable having a brush assembly affixed thereto for cleaning the interior surfaces of tubes, a protective casing covering the cable, a portable head member carried by an operator having an elongated path defining a line of travel for receiving and directing the cable for insertion into and withdrawal from each tube, means engaging the protective casing intermediate the ends of the cable for forward and reverse propelling of the cable through the head member and into and out tubes for cleaning the interior surfaces of the tubes, a motor for driving the cable propelling means in the forward and reverse directions and for rotating the cable within its casing, and the portable head having control means cooperating with the motor for enabling the operator to select forward and reverse movement and rotation of the cable and brush assembly while cleaning each tube.

15. A tube cleaning apparatus as defined in claim 14 in which the means engaging the protective casing is located within the portable head member.

* * * * *